US005775525A

United States Patent [19]

Brill

[11] Patent Number: 5,775,525

[45] Date of Patent: Jul. 7, 1998

[54] MAGNETIC COUPLING ASSEMBLY FOR MODEL RAILROAD CARS AND COUPLING SYSTEM THEREFOR

[76] Inventor: Gilbert A. Brill, 17423 W. 17th Pl., Golden, Colo. 80401

[21] Appl. No.: 745,011

[22] Filed: Nov. 7, 1996

[51] Int. Cl.[6] ..... B61G 5/00

[52] U.S. Cl. ..... 213/75 TC; 213/75 D

[58] Field of Search ..... 213/77, 110, 75 D, 213/75 TC; 105/157.2

[56] References Cited

U.S. PATENT DOCUMENTS

| | | |
|---|---|---|
| D. 281,187 | 10/1985 | Wiese . |
| D. 326,693 | 6/1992 | Gramera . |
| 3,469,713 | 9/1969 | Edwards . |
| 3,564,766 | 2/1971 | Edwards . |
| 5,509,546 | 4/1996 | Staat . |

OTHER PUBLICATIONS

Coupling Cars Together, R. Larson, N. Scale Primer, pp. 47–48, 1974.

*Primary Examiner*—S. Joseph Morano
*Attorney, Agent, or Firm*—Michael R. Henson; Timothy J. Martin

[57] ABSTRACT

A magnetic coupling assembly for model railroad cars. The assembly comprises a retainer adapted for attachment to a car and magnet mounted on the retainer. The magnet may have a cylindrical shape with faces of opposite polarity, and it may be mounted on a pivot pin connected to the retainer, allowing the magnet to pivot freely about the pin. A kingpin may attach the assembly to a model railroad car between a truck assembly and the car body, or the coupling assembly may be integral with a truck assembly. A model railroad car may be mounted with one or more coupling assemblies. Adjacent cars are coupled when the magnets of their respective assemblies contact one another.

14 Claims, 2 Drawing Sheets

MAGNETIC COUPLING ASSEMBLY FOR MODEL RAILROAD CARS AND COUPLING SYSTEM THEREFOR

FIELD OF INVENTION

The present invention broadly concerns coupling assemblies for use with model railroad cars. More particularly, the present invention is directed to magnetic coupling assemblies adapted for releasable connection to the wheeled trucks of small-scale model railroad cars, and coupling systems incorporating the same.

BACKGROUND OF THE INVENTION

For years, model railroad enthusiasts have enjoyed small-scale model cars and locomotives which duplicate the features of full-size trains. Two popular sizes for model railroad cars are commonly referred to as the HO gauge and the N gauge. HO gauge trains bear a linear ratio to full size railroad equipment of 1 to 87, while N gauge trains are even smaller. It is desirable that the particular scale be preserved in all features, including the coupling mechanism for the cars and locomotives, so that the cars closely resemble those of actual trains. At the same time, structural dependability of the cars also remains an important consideration.

Two types of couplers are in general use, the RAPIDO style and the KADEE style, also referred to as the Magne-Matic. However, particularly for N scale cars, these coupling mechanisms are oversized relative to the scale of the cars, thereby detracting from their overall appearance.

A RAPIDO style coupler is generally J-shaped in configuration and, when mounted on a car or locomotive, the open mouth of the coupler faces one of the two rails of the track. A proximal end of the coupler is connected to the railroad car's wheeled truck and operates to pivot in a vertical direction relative to the car. In order to couple two cars together, one car is moved toward the other until the respective couplers meet. The open mouths of the couplers are oppositely oriented and when they engage, one coupler rides over the other and then falls into place, with the "Js" engaging each other. Coupling can occur on curved or straight sections of the track. To uncouple the cars, however, one coupler must be lifted over the other as the cars are separated. This can be accomplished in several ways. The end of one car can either be raised manually, or a bent piece of wire can be utilized to raise one coupler over the other manually. Alternatively, an uncoupling ramp may be used. Typically, the uncoupling ramp is equipped with a plunger having a small shoe on top. When the ramp is activated, the plunger rises and the shoe pushes upwardly on the small uncoupler pin which projects downwardly therefrom.

Unfortunately, there are several problems associated with the use of RAPIDO style couplers. For successful coupling to occur, the two cars must approach each other at somewhat unrealistic speeds, resulting in displacement of the cars and sometimes derailment. Alternatively, the operator may manually restrain one of the cars, but this also can result in frequent derailments. When uncoupling ramps are employed, the unit to be uncoupled must be located precisely so that the uncoupling pin is directly over the plunger. Also, an uncoupling ramp must be installed at every location where a unit is to be uncoupled. Derailments are also common when cars are uncoupled by one of the manual methods. Due to the small size and light weight of an N scale car, it is particularly cumbersome to replace a derailed car on the track.

RAPIDO couplers also have an unrealistic appearance. For reliable performance, the couplers must be disproportionately large relative to their respective cars, thereby increasing separation distance between adjacent cars. Moreover, the couplers do not resemble those used on full-scale railroad equipment.

KADEE couplers, on the other hand, are knuckle-type couplers similar in appearance and operation to those used on full-scale railroad equipment. They are furnished with some brands of model railroad units and are also available as conversion kits for replacing RAPIDO style couplers. However, the conversion kits are difficult to install on N scale cars due to the small size of the parts.

KADEE couplers open and close with a scissoring action. Each coupler is equipped with a curved steel uncoupling pin which extends downwardly and is firmly attached to the coupler knuckle. When two couplers are pushed together, the knuckles first spread apart and thereafter return to their normal positions to engage one other due to the resiliency of an internal lateral spring.

KADEE couplers may also be uncoupled manually, presenting the same derailment problems that are encountered with manual uncoupling of RAPIDO couplers. Alternatively, a magnetically polarized uncoupling ramp can be placed between the tracks ahead of the drop-off location. The train is momentarily stopped so that the units to be uncoupled are positioned over the ramp. When the train stops, the couplers are no longer in tension, and the uncoupling pins are pulled sideways by the magnetic field of the ramp, causing the knuckles to rotate and disengage. The uncoupled units remain uncoupled as the train pulls away.

KADEE couplers operate reliably on straight sections of track while the train is in motion. However, coupling cannot be accomplished on curves with a radius less than eleven inches, despite the fact that N scale trains can be operated on tracks with radii as small as seven inches. Thus, drop-off points must be strategically located.

While the coupling assemblies discussed above have enjoyed much success over the years, there is a growing need for improved couplers for model trains which are similar in both appearance and scale to those used in full-scale railroad equipment. There is a further need for an improved coupling system which will work reliably on a variety of track configurations. There is yet another need for a coupling system which can be operated reliably with a reduced risk of derailment. The present invention is directed to satisfying these needs, among others.

SUMMARY OF THE INVENTION

It is an object of the present invention to provide a new and improved coupling assembly for model railroad trains which is similar in appearance and scale to couplers used with full-scale railroad equipment.

A further object of the present invention is to provide a coupling assembly which will work reliably on tightly curved sections of track, with a reduced risk of derailment.

Another object of the present invention is to provide such a coupling assembly which is easy to manufacture and which incorporates fewer working parts compared to coupling assemblies currently in use.

It is a still further objective to provide a coupling assembly which can be easily installed as a retrofit on the wheeled trucks of small scale model railroad cars.

Yet another object of the present invention is to provide a new and improved coupling system for use with model railroad cars.

To achieve the foregoing and other objects and in accordance with the purpose of the present invention broadly described herein, one embodiment of this invention comprises a coupling assembly adapted for releasable connection to a model vehicle which includes a body and a wheeled truck. The coupling assembly comprises a retainer which includes a proximal end portion adapted for releasable engagement with the body and a distal end portion upon which a magnet is disposed. The distal end portion may be formed as a clevis structure having a pair of opposed, spaced apart clevis members, with the magnet disposed between the members. To facilitate coupling of small scale cars, the magnet may be mounted pivotally. For example, a magnet bore may be formed in the magnet, and a pivot pin received through the bore may be connected to the clevis members. The magnet may be constructed with parallel faces having opposite polarities, with a surrounding sidewall connecting the faces. For example, the magnet may be constructed as a cylinder, with the magnet bore extending through the sidewall between the faces. The magnet may be a permanent magnet, and it may comprise neodymium. The proximal end of the coupling assembly may include a mounting hole formed therethrough which is sized and adapted to matably receive a kingpin associated with the railroad car. The coupling assembly may be capable of rotation about the kingpin and with respect to the car body. Further, the assembly may be adapted to prevent rotation of the retainer relative to the truck, or it may be rigidly attached to or integral with the truck.

One or more such coupling assemblies may be associated with a model railroad car which advances along a path, such as a track. The car comprises a body having a first end and a second end. The car also comprises a first truck which includes a first wheeled assembly and a first magnet pivotally mounted to the car relative to the first end. The car may additionally comprise a second truck which includes a second wheeled assembly and a second magnet pivotally mounted to the car relative to the second end. Each truck is rotatably attached to the body proximate to the respective end and supports the body above the path. Each truck is also sized and adapted to advance along the path. Each magnet may be oriented so that it pivots about a pivot pin which is oriented vertically with respect to the path.

A first coupling assembly and a second coupling assembly can be combined to form a coupling system for model railroad cars. The assemblies are capable of pivotal attachment relative to a first and a second model railroad car, respectively. Each assembly includes a magnet pivotally disposed on a retainer, and each retainer is capable of pivotal attachment relative to one of the respective model railroad cars. The magnets are positioned to magnetically engage each other, thereby coupling the first car to the second car when each assembly is attached to its associated railroad car. At least one of the first and second model railroad cars includes a wheeled truck sized and adapted to support the at least one car and advance the at least one car along a path, such as a model railroad track. The retainer associated with the at least one car is adapted to prevent rotation of the retainer with respect to its associated truck. That retainer may be rigidly attached to the truck, or it may be integral with the truck.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENTS

The present invention is generally directed to a system for coupling model railroad cars. It is particularly suited for use with N gauge cars, but it is to be understood that the present invention may be utilized with model railroad cars of other scales, as well as other types of model vehicles. The present invention utilizes magnets to couple cars to each other. As used herein, the terms "model railroad car" and "car" include cars adapted for inclusion in the middle of a train, as well as cabooses, locomotives, or other cars adapted for placement at the beginning or end of a train.

Figure 1:
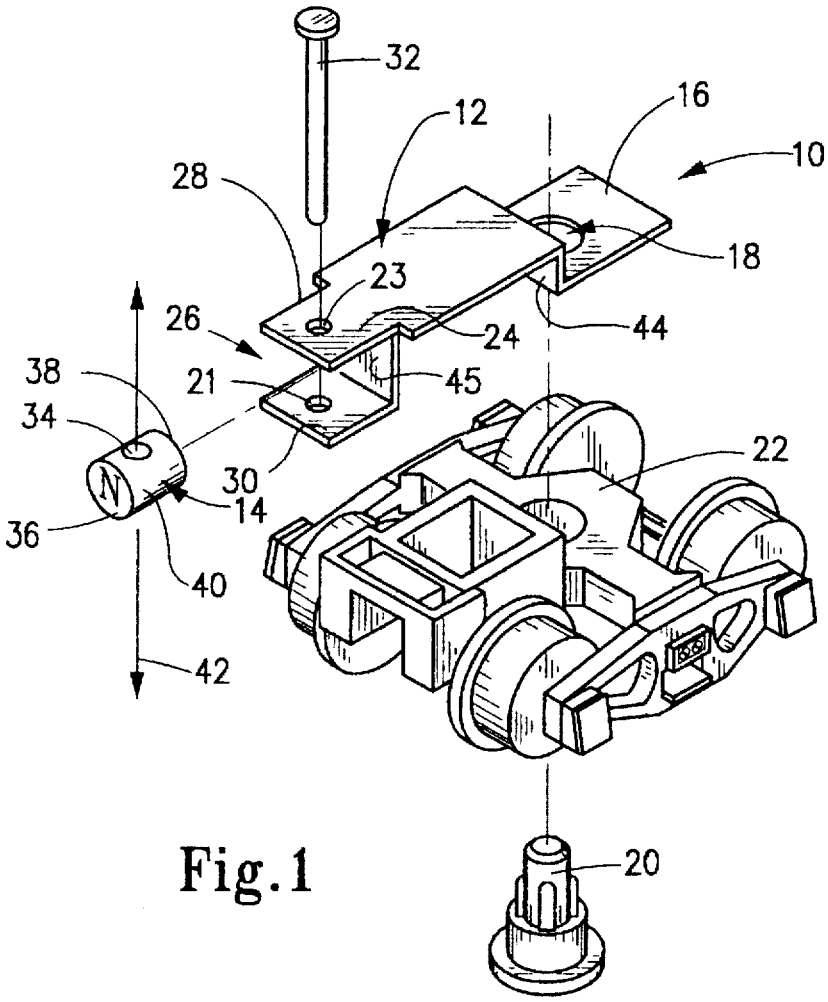
FIG. 1 is an exploded perspective view showing the releasable attachment of a first exemplary embodiment of the magnetic coupling assembly according to the present invention to a wheeled truck assembly.

A first exemplary embodiment for the coupling assembly of the present invention is introduced in FIG. 1. Coupling assembly 10 broadly includes a retainer 12 and a magnet 14. Retainer 12 is adapted for releasable connection to the wheeled truck 22 of a model railroad car. It is preferred that both retainer 12 and wheeled truck 22 can rotate relative to their associated car to facilitate motion of a train of coupled cars along a curved path. As shown in FIG. 1, a proximal end portion 16 of retainer 12 includes a mounting hole 18 formed therethrough which is sized and adapted so that the shaft of a kingpin 20 can pass through mounting hole 18 and mate wheeled truck 22 with a railroad car, as discussed in more detail below with reference to FIG. 5. As is apparent to one skilled in the art, various types of kingpins may be utilized, and kingpin 22 may be integral with truck 22. A magnet 14 is disposed at the distal end portion 24 of retainer 12. For example, as shown in FIG. 1, distal end portion 24 of retainer 12 is preferably formed as a clevis structure 26 having a pair of opposed, spaced apart clevis members 28 and 30. Magnet 14 is mounted for pivotal movement between clevis members 28 and 30.

Preferably, magnet 14 is pivotally mounted between clevis members 28 and 30 by means of a pivot pin 32 passing through a pair of opposed holes 21 and 23 formed in clevis structure 26 and a bore 34 formed through magnet 14, thereby to interconnect magnet 14 to retainer 12. It is also preferred that magnet 14 be formed as a cylinder having two oppositely polarized parallel faces 36 and 38 separated by a surrounding sidewall 40. As shown in FIG. 1, bore 34 passes through sidewall 40 between faces 36 and 38, although variations of this configuration are certainly contemplated. Particularly if the coupling assembly 10 is to be used with a small gauge car, such as an N gauge car, it is preferable that magnet 14 be able to pivot freely about an axis 42 defined by bore 34 and pivot pin 32, thereby facilitating orientation of magnet 14 in the presence of an external magnetic field, such as a field provided by another magnet.

It is preferred that retainer 12 be constructed to be substantially immovable relative to truck 22. As such, retainer 12 is formed to rest upon truck 22 and includes two walls, such as wall 44 and wall 45, which abut truck 22 and prevent retainer 12 from any sliding or pivoting relative to truck 22.

Figure 2:
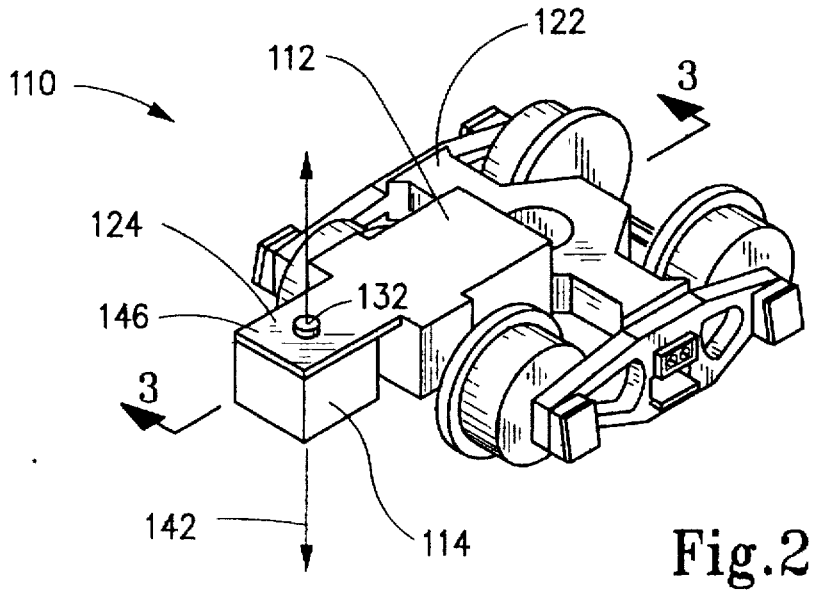
FIG. 2 is a perspective view of a wheeled truck assembly incorporating a magnetic coupling assembly according to the second exemplary embodiment of the present invention.
Figure 3:
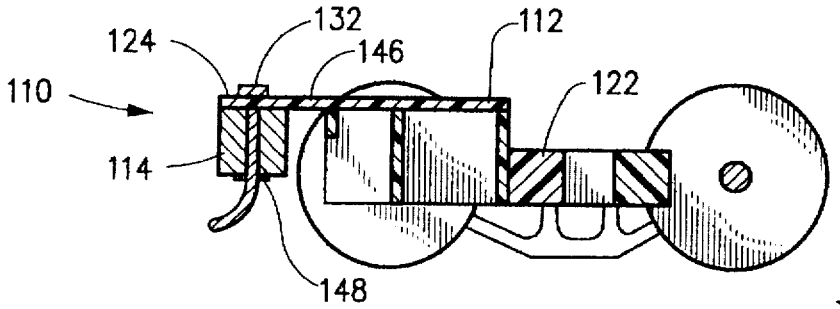
FIG. 3 is a side view in cross-section about lines 3—3 in FIG. 2.

A second exemplary embodiment of the present invention is illustrated in FIGS. 2 and 3, where coupling assembly 110 is shown to be formed integrally with truck 122. Alternatively, coupling assembly 110 could be rigidly attached to truck 122 by screws, bolts, or any other means known to those skilled in the art. Here, distal end portion 124 of retainer 112 is in the from of a bracket 146 and magnet 114 is suspended from bracket 146, such as by a weldment 148 or by any method known to those skilled in the art. Preferably, magnet 114 is attached to bracket 146 in a manner that permits free pivoting about a central axis 142 of magnet 114. With this embodiment, then, it may be appreciated that magnet 114 and pivot pin 132 are mounted for common rotation relative to bracket 146.

Figure 4:
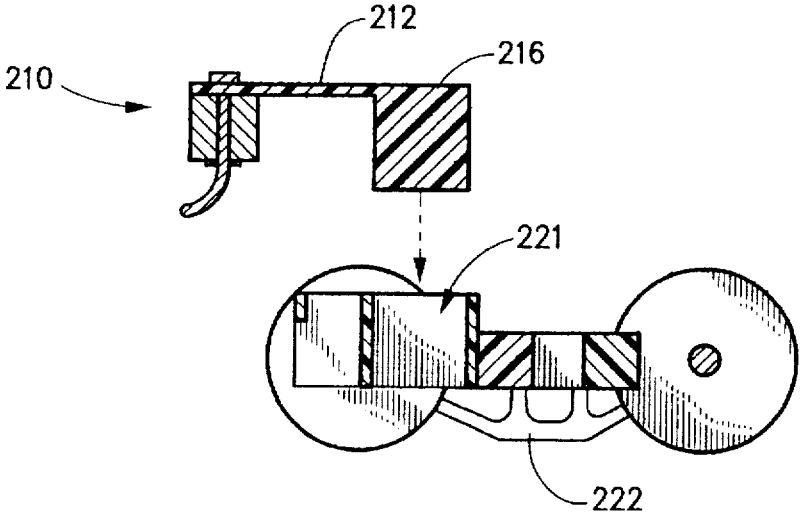
FIG. 4 is an exploded side view, in cross-section, of a third exemplary embodiment of the magnetic coupling assembly of the present invention.

A third exemplary embodiment of the coupling assembly 210 of the present invention may be appreciated now with reference to FIG. 4, wherein it is seen that the proximal end portion 216 of retainer 212 is sized for insertion into a cavity 221 formed in wheeled truck 222. Accordingly, the retainer 212 of coupling assembly 210 is fixedly positioned relative to wheeled truck 222 and is held in cavity 221 by virtue of a friction fit. Of course, this third exemplary embodiment of the coupling assembly of the present invention, as well as the second exemplary embodiment discussed above with reference to FIGS. 2 and 3, illustrates some alternative constructions for the retainer which permit it to be mounted to the wheeled truck independently of the kingpin.

Figure 5:
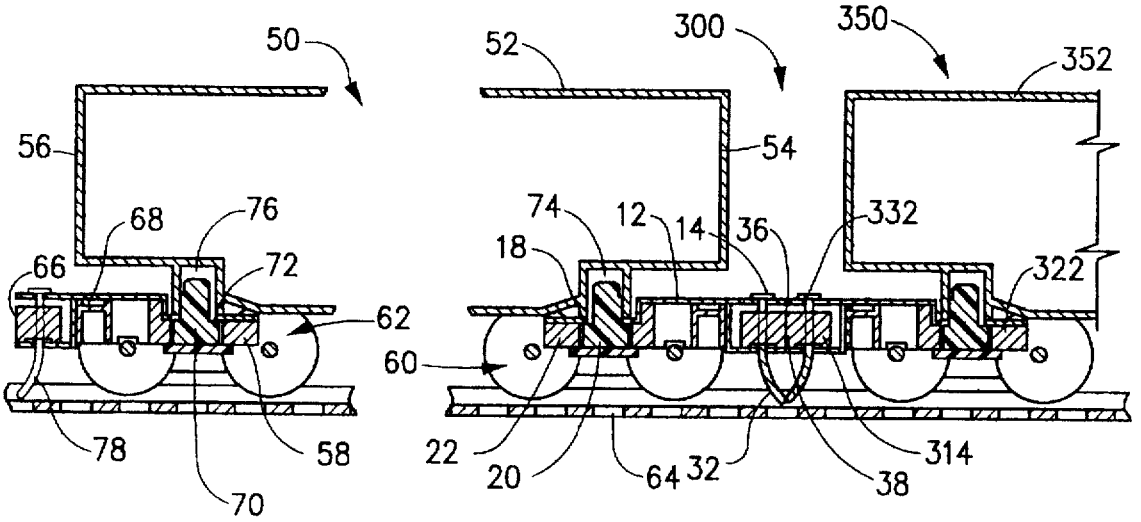
FIG. 5 is a side view in cross-section, and broken away, of two model railroad cars coupled in accordance with the present invention.

In accordance with the present invention, a model railroad car may also be equipped with more than one magnetic coupling assembly, as illustrated for car 50 in FIG. 5. Body 52 of car 50 has a first end 54 and a second end 56. First truck 22 and second truck 58 each have a wheeled assembly, 60 and 62 respectively, which is sized and adapted to support their associated end 54, 56 above track 64. First magnet 14 and second magnet 66 are each pivotally mounted to the respective ends of car 50 by means of retainers 12 and 68. Retainers 12 and 68 are each releasably secured to their respective ends of car 50. For example, kingpins 20 and 70 respectively pass through holes 18 and 72 in retainers 12 and 68 and are held in recesses 74 and 76 by friction. As shown in FIG. 5, each retainer has the clevis structure shown in FIG. 1 with a magnet pivotally mounted between the spaced apart members. The magnets 14 and 66 are mounted so that pivot pins 32 and 78 are oriented substantially vertical with respect to track 64. As shown, pivot pins 32 and 78 are bent for aesthetic reasons.

With the foregoing in mind, the present invention also provides for a coupling system for coupling two or more model railroad cars into a train, as also illustrated in FIG. 5. For example, in coupling system 300, a first car 50 has a first retainer 12 mounted at one end of the car, between first truck 22 and first car body 52. A second car 350 is similarly equipped with a retainer 312 mounted at one end of the car, between truck 322 and second car body 352. The wheels of the trucks 22 and 322 rest upon a path over which the train can travel. The path may be an arbitrarily chosen path on a surface, such as a floor or table. The path may also be a conventional model railroad track, such as track 64 in FIG. 5, or it may be another type of railed path, such as a monorail. Trucks 22, 72, and 322 are sized and adapted so that their wheels can roll along track 64.

Initially, first car 50 and second car 350 are separated. Because each magnet 14 and 314 can pivot freely on its associated pivot pin 32 and 332, each aligns itself in the external magnetic field of the other as the cars approach each other. Thus, magnets 14 and 314 pivot on pins 32 and 332 so that faces 36 and 338 are aligned with opposite poles adjacent one another. Faces 36 and 338 make contact with each other, thereby joining first car 50 and second car 350. To separate the first car from the second car, the model railroad operator can simply press down on the first end 54 of first car 50, thereby sliding magnets 14 and 314 apart. Second car 350, along with any other cars attached to it, can then be moved apart from first car 50. Because the pressure is applied downward to the end of first car 50, there is a low probability of derailment as the cars are separated. Alternatively, the operator can simply grasp the cars and urge them apart. Of course, while the railroad car and the coupling system 300 shown in FIG. 5 have been described in reference to a coupling assembly according to the first exemplary embodiment of the present invention, it should be readily appreciated that the coupling assemblies described herein with reference to FIGS. 2–4 may also be employed.

As is apparent from the foregoing discussion, retainers and magnets should be selected so that their sizes maintain the proper spacing between cars in accordance with the scale of the cars. The strength of each magnet's field should be strong enough so that magnetically coupled cars can be pulled in a train without separating unintentionally, yet small enough to allow the cars to be deliberately separated without requiring the application of so much force to the cars that they will be damaged. For N gauge cars, neodymium magnets are preferred.

The foregoing description is considered as illustrative only of the principles of the invention. Further, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. In a truck adapted for pivotal attachment to a body of a railroad car wherein said truck includes a cavity formed therein and a wheeled assembly sized and adapted to engage a track and to advance therealong, the improvement comprising a coupling assembly mounted to said truck, said coupling assembly including a retainer releasably securable to said truck and having a proximal end portion which is sized and adapted to be retained in the cavity by a friction fit and a distal end portion, and including a magnet disposed on said distal end portion.

2. The improvement of claim 1 wherein said magnet is pivotally disposed on said retainer about a pivot axis passing through said magnet.

3. The improvement of claim 2 wherein said magnet is constructed as a cylinder having two oppositely polarized, parallel faces and a surrounding sidewall extending therebetween, and including a pivot pin adapted to interconnect said magnet and said retainer.

4. The improvement of claim 1 wherein said magnet is a permanent magnet.

5. The improvement of claim 1 wherein said magnet comprises neodymium.

6. The improvement of claim 1 wherein said distal end portion is constructed as a clevis having a pair of opposed, spaced apart clevis members, said magnet suspended for pivotal movement between said clevis members.

7. The improvement of claim 1 wherein said retainer includes a clevis structure having a pair of opposed, spaced apart clevis members, said magnet mounted for pivotal movement between said clevis members.

8. A model railroad car adapted to advance along a path, the car comprising:

(a) a body having a first end and a second end;

(b) a first truck including a first wheeled assembly sized and adapted to advance along the path, said first truck rotatably attached to said body proximate to said first end and operative to support said first end above the path;

(c) a first coupling assembly associated with said first truck, said first coupling assembly including a first retainer mounted for common movement with said first truck and formed integrally therewith, and including a first magnet mounted to said car relative to said first end;

(d) a second truck including a second wheeled assembly sized and adapted to advance along the path, said second truck rotatably attached to said body proximate to said second end and operative to support said second end above the path; and (e) a second coupling assembly associated with said second truck, said second coupling assembly including a second retainer mounted for common movement with said truck and formed integrally therewith, and including a second magnet mounted to said car relative to said second end.

9. A railroad car according to claim 8 wherein said first retainer is adapted to interconnect said first magnet to said first end and said second retainer is adapted to interconnect said second magnet to said second end.

10. A railroad car according to claim 9 wherein each said first and second retainer includes a proximal end portion interposed between its associated said truck and said body and a distal end portion formed as a clevis structure having a pair of opposed, spaced apart clevis members.

11. A railroad car according to claim 10 wherein each said first and second magnet is mounted for pivotal rotation between the clevis members of its associated one of said first and second retainers.

12. A railroad car according to claim 8 wherein said first magnet is pivotally mounted to said car relative to said first end and said second magnet is pivotally mounted to said car relative to said second end.

13. A model railroad car adapted to advance along a path, the car comprising:

(a) a body having a first end and a second end;

(b) a first truck including a first wheeled assembly sized and adapted to advance along the path, said first truck rotatably attached to said body proximate to said first end and operative to support said first end above the path; and (c) a first coupling assembly associated with said first truck, said first coupling assembly including a first retainer mounted for common movement with said first truck and a first magnet mounted to said first retainer.

14. A railroad car according to claim 13 additionally comprising a second truck including a second wheeled assembly sized and adapted to advance along the path, said second truck rotatably attached to said body proximate to said second end and operative to support said second end above the path, and a second coupling assembly associated with said second truck, said second coupling assembly including a second retainer mounted for common movement with said second truck and a second magnet mounted to said second retainer.

* * * * *